US006761509B2

(12) United States Patent
Jansson

(10) Patent No.: US 6,761,509 B2
(45) Date of Patent: Jul. 13, 2004

(54) CONCRETE MODULE FOR RETAINING WALL AND IMPROVED RETAINING WALL

(76) Inventor: Jan Erik Jansson, 814 S. Sierra Ave., Solana Beach, CA (US) 92075-2616

( * ) Notice: Subject to any disclaimer, the term of this patent is extended or adjusted under 35 U.S.C. 154(b) by 0 days.

(21) Appl. No.: 10/205,727

(22) Filed: Jul. 26, 2002

(65) Prior Publication Data

US 2004/0018061 A1 Jan. 29, 2004

(51) Int. Cl.[7] ..... E02D 29/02
(52) U.S. Cl. ..... 405/286; 405/284; 405/262
(58) Field of Search ..... 405/286, 284, 405/262, 302.4, 302.6, 302.7; D25/113, 114; 52/562, 596, 604, 605, 606, 608, 607

(56) References Cited

U.S. PATENT DOCUMENTS

| | | | | |
|---|---|---|---|---|
| 4,884,921 A | * | 12/1989 | Smith | 405/286 |
| 5,066,169 A | | 11/1991 | Gavin et al. | |
| 5,072,566 A | | 12/1991 | Zeidman | |
| 5,108,231 A | * | 4/1992 | Rausch | 405/284 |
| 5,177,925 A | * | 1/1993 | Winkler et al. | 52/608 X |
| 5,257,880 A | * | 11/1993 | Janopaul, Jr. | 405/284 |
| 5,419,092 A | * | 5/1995 | Jaecklin | 52/562 |
| 5,564,865 A | * | 10/1996 | Jansson | 405/286 |
| 5,595,460 A | * | 1/1997 | Miller et al. | 405/284 |
| 6,019,550 A | * | 2/2000 | Wrigley et al. | 405/262 |
| 6,287,054 B1 | * | 9/2001 | Egan et al. | 405/262 |
| 2002/0187010 A1 | * | 12/2002 | MacDonald et al. | 405/284 |

FOREIGN PATENT DOCUMENTS

| | | | |
|---|---|---|---|
| EP | 0047718 | * | 9/1981 |
| JP | 6-207417 | * | 7/1994 |

OTHER PUBLICATIONS

Brochure of Loffel Retaining Walls, Inc., Carlsbad, California, "Loffelstein Retaining Walls", 1988.
Manual of Loffel Retaining Walls, Inc., Carlsbad, California, "Loffelstein Engineering manual", 1988.

* cited by examiner

*Primary Examiner*—Heather Shackelford
*Assistant Examiner*—Sunil Singh
(74) *Attorney, Agent, or Firm*—Wood, Phillips, Katz, Clark & Mortimer

(57) ABSTRACT

A retaining wall with stacked courses of concrete modules, each module having an upright front wall, two upright lateral walls, and a bottom wall. Each lateral wall has a front edge adjoining the front wall, a back edge spaced from the front edge, and upright ribs extending in-wardly outwardly from the lateral wall. The upright ribs are spaced equally from the front wall. Each lateral wall also has a provision for receiving a batten which, if pulled backwardly, bears against the upright ribs. A geogrid is anchored to the modules by the batten.

10 Claims, 2 Drawing Sheets

CONCRETE MODULE FOR RETAINING WALL AND IMPROVED RETAINING WALL

TECHNICAL FIELD OF THE INVENTION

This invention pertains to improvements in a concrete module of a type disclosed in U.S. Pat. No. 5,564,865, the disclosure of which is incorporated herein by reference, and to improvements in a retaining wall of a type disclosed therein.

BACKGROUND OF THE INVENTION

As disclosed in U.S. Pat. No. 5,564,865, supra, a concrete module useful in making a retaining wall has unitary walls including a front wall, two lateral walls, and a bottom wall. The front and lateral walls are upright. Each lateral wall has a front edge adjoining the front wall, a back edge spaced from the front edge, an upright rib extending inwardly from said lateral wall, and an upright rib extending outwardly from said lateral wall. The upright ribs are spaced equally from the front wall. A batten, which is used to anchor a geogrid to the concrete module, has two opposite ends bearing against the upright ribs extending inwardly from the lateral walls. U.S. Pat. No. 5,564,865, supra, discloses a retaining wall comprising multiple course of said concrete modules.

According to an older design, a concrete module similar to the concrete module disclosed in German Published Patent Application (Offenlegungsschrift) No. 2,537,408 and useful in making a retaining wall had similar front, lateral, and bottom walls, except that the lateral walls did not have any inwardly or outwardly extending ribs. Each lateral wall of the concrete module similar thereto had a recess opening upwardly, as a provision to receive a batten, which could extend laterally from the concrete module in either direction.

Other older designs for concrete modules useful in making retaining walls are disclosed in U.S. Pat. No. 5,066,169, U.S. Pat. No. 5,072,566, two "Loffelstein" publications, and other references cited on the title page of U.S. Pat. No. 5,564,865, supra.

SUMMARY OF THE INVENTION

This invention provides improvements in a concrete module of the type noted above. The concrete module is useful in making a retaining wall. The concrete module is similar to the concrete module disclosed in U.S. Pat. No. 5,564,865, supra, in having unitary walls including a front wall, two lateral walls, and a bottom wall, the front and lateral walls being upright, each lateral wall having a front edge adjoining the front wall, a back edge spaced from the front edge, and an upright rib extending laterally from said lateral wall.

This invention contemplates each lateral wall having a provision, such as a recess opening upwardly or an opening extending through said lateral wall, which is adapted to receive a batten so that the batten can extend through said lateral wall and which is positioned where the batten if pulled backwardly can bear against the upright rib of said lateral wall. Although the upright rib of each lateral wall can extend inwardly or outwardly from said lateral wall, each lateral wall having two upright ribs aligned laterally, one extending inwardly from said lateral wall and one extending outwardly from said lateral wall, is preferred.

This invention provides a retaining wall comprising a course of concrete modules, as described above, and further comprising a batten, which is received by the provisions of the lateral walls of the concrete modules of the course so that the batten if pulled backwardly can bear against the upright ribs of the lateral walls of the concrete modules of the course. This invention provides a retaining wall stacked courses of concrete modules, as described above, and further comprising, in each of at least some of the courses, a batten, which is received by the provisions of the lateral walls of the concrete modules so that the batten if pulled backwardly can bear against the upright ribs of the lateral walls of the concrete modules of the course.

BRIEF DESCRIPTION OF THE DRAWINGS

FIG. 3 illustrates fragmentarily, in broken lines, a batten coacting with the similar modules of the upper course.

FIG. 4 illustrates fragmentarily, in broken lines, a batten coacting with the concrete modules of the exemplary course.

DETAILED DESCRIPTION OF THE ILLUSTRATED EMBODIMENTS

Figure 1:
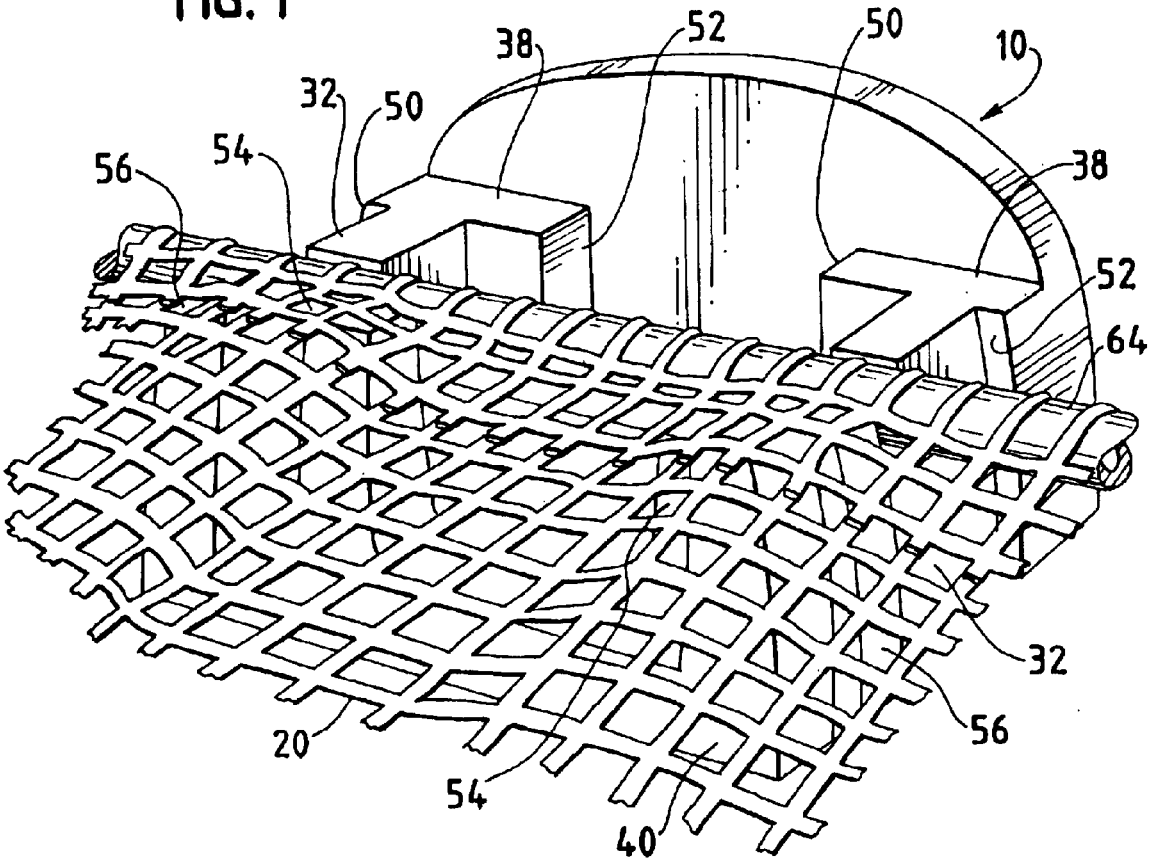
FIG. 1 is a perspective view illustrating a concrete module according to a preferred embodiment of this invention, as combined with a geogrid and a batten in a manner contemplated by this invention. The geogrid and the batten are illustrated fragmentarily.
Figure 2:
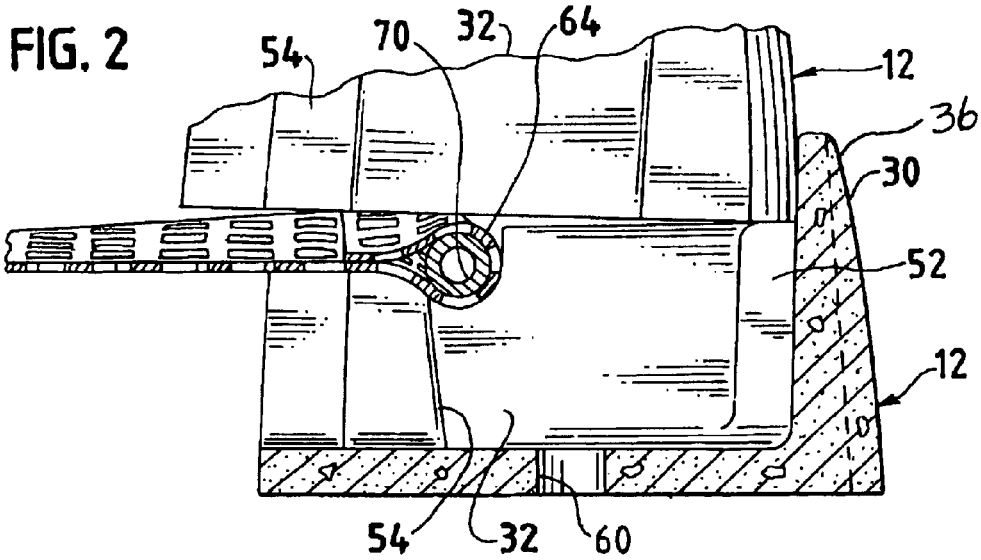
FIG. 2, on a smaller scale compared to FIG. 1, is a front-to-back, cross-sectional view taken through the concrete module, the geogrid, and the batten of FIG. 1 and through a similar module stacked onto the concrete module, in a retaining wall.
Figure 3:
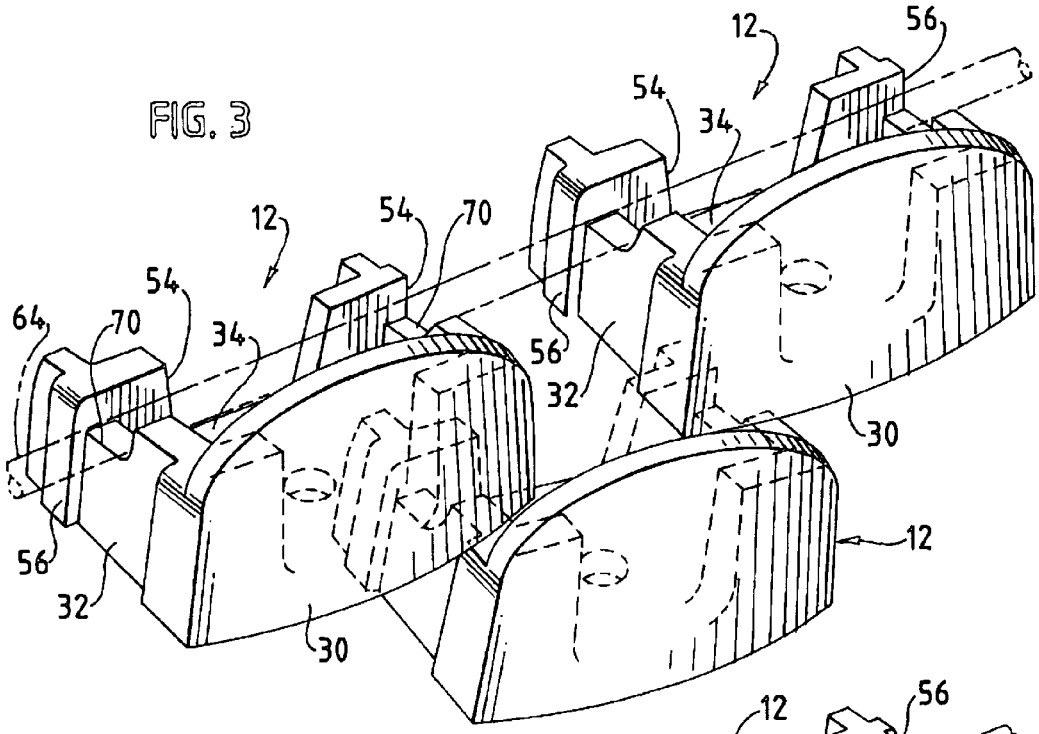
FIG. 3, on a similar scale, is a perspective view illustrating two similar modules in an upper course of two successive courses of a retaining wall and illustrating one similar module in a lower course of the successive courses of the retaining wall.

Except as illustrated in FIGS. 1, 2, and 3 and described herein, a concrete module 12 constituting a preferred embodiment of this invention is similar to the concrete module disclosed in U.S. Pat. No. 5,564,865, supra, and can be similarly used in a retaining wall 10. Thus, the concrete module 12 has an open-topped, open-backed, trough-like configuration, which is defined by a front wall 30, two lateral walls 32, and a bottom wall 34. The front wall 30 has an upper portion 36 extending above the lateral walls 32. Each lateral wall 32 has a front edge 38 adjoining the front wall 30 and a back edge 40 spaced from the front wall 30.

Each lateral wall 32 has an upright, inwardly extending front rib 50 adjoining the front wall 30 along the front edge 38 of said lateral wall 32. Also, each lateral wall 32 has an upright, outwardly extending front rib 52 adjoining the front wall 30 along the front edge 38 of said lateral wall 32 and aligned laterally with the rib 50 of said lateral wall 32. Each lateral wall 32 has an upright, inwardly extending back rib 54 adjoining the front wall 30 near the back edge 40 of said lateral wall 32. Also, each lateral wall 32 has an upright, outwardly extending back rib 56 aligned laterally with the rib 54 of said lateral wall 32. The bottom wall 34 has a central aperture 60.

On each lateral wall 32, the back ribs 54, 56, are spaced frontwardly from the back edge 40, backwardly from the front edge 38, and backwardly from the front ribs 50, 52. Being open-backed, as illustrated, the concrete module 12 is open above the bottom wall 34, between the lateral walls 32, which include the front ribs 50, 52, and which include the back ribs 54, 56, from the front wall 30 to the back edges 40 of the lateral walls 32.

In the preferred embodiment illustrated in FIGS. 1, 2, and 3, as a provision adapted to receive a batten 64, each lateral wall 32 has a recess 70 opening upwardly. The recess 70, which is adapted to receive the batten 64 so that the batten 64 can extend through said lateral wall 32, is positioned where the batten 64 if pulled backwardly can bear against the back ribs 54, 56, of said lateral wall 32.

Figure 4:
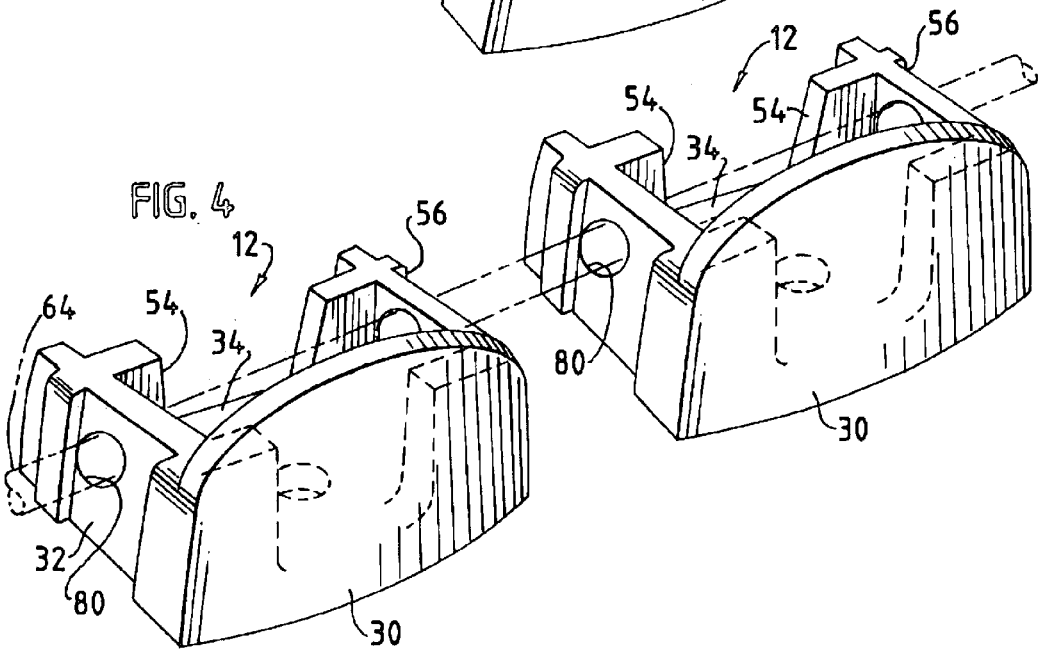
FIG. 4, on a similar scale, is a perspective view illustrating two concrete modules according to an alternative embodiment of this invention, in an exemplary course of a retaining wall.

In an alternative embodiment illustrated in FIG. 4, as a provision adapted to receive the batten 64, each lateral wall 32 has an opening 80 through said lateral wall 32. The opening 80, which is adapted to receive the batten 64 so that the batten 64 can extend through said lateral wall 32, is positioned where the batten 64 if pulled backwardly can bear against the back ribs 54, 56, of said lateral wall 32.

Preferably, in either illustrated embodiment, the batten 64 is a piece of polyvinyl chloride pipe. The batten 64 is connected to a geogrid 20, which is illustrated schematically, of a type disclosed in U.S. Pat. No. 5,564,865, supra, in a manner disclosed therein, whereby the geogrid 20 is anchored to the concrete modules 12 coacting with the batten 64.

In the preferred embodiment, as compared to the geogrid illustrated and described in U.S. Pat. No. 5,564,865, supra, there is no need to provide notches in the geogrid 20 so as to accommodate the lateral walls 32. In the alternative embodiment, the geogrid 20 is notched, as in U.S. Pat. No. 5,564,865, supra.

Advantageously, in either illustrated embodiment, the back ribs 54, 56, reinforce the lateral walls 32 where forces are imposed by the batten 64 if pulled backwardly. Moreover, in either illustrated embodiment, the batten 64 can extend through at least some of the concrete modules 12 in a given course of the retaining wall 10. Therefore, the batten 64 can function not only to anchor the geogrid 20 to those modules 12 but also to align those modules 12 and to help to stabilize those modules 12, whereby to help to stabilize the retaining wall 10.

Whichever illustrated embodiment is used, other geogrids can be also anchored to the concrete modules 12 in a given course of such a retaining wall 10, by other battens, in a manner disclosed in U.S. Pat. No. 5,564,865, supra. Moreover, the retaining wall 10 can be post-tensioned in a manner disclosed in U.S. Pat. No. 5,564,865, supra.

What is claimed is:

1. A retaining wall comprising stacked courses of concrete modules, wherein each concrete module has unitary walls including a front wall, two lateral walls, and a bottom wall, each lateral wall having a front edge adjoining the front wall, a back edge spaced from the front edge, and an upright rib extending inwardly from said lateral wall and an upright rib extending laterally from said lateral wall, each said rib being spaced frontwardly from the back edge of said lateral wall and backwardly from the front edge of said lateral wall, each concrete module being open above the bottom wall, wherein the bottom wall extends between the lateral walls, which include the upright ribs, from the front wall to the back edges of the lateral walls, and wherein the retaining wall further comprises, in at least some of the courses, a batten extending through the lateral walls of a plural number of the concrete modules so that the batten if pulled backwardly can bear against the upright ribs of the lateral walls, through which the batten extends, of the plural number of the concrete modules.

2. The retaining wall of claim 1, wherein a geogrid is anchored to the retaining wall by the batten.

3. A retaining wall comprising stacked courses of concrete modules, wherein each concrete module has unitary walls including a front wall, two lateral walls, and a bottom wall, each lateral wall having a front edge adjoining the front wall, a back edge spaced from the front edge, and an upright rib extending inwardly from said lateral wall and an upright rib extending inwardly from said lateral wall, each said rib being spaced frontwardly from the back edge of said lateral wall and backwardly from the front edge of said lateral wall, each concrete module being open above the bottom wall, wherein the bottom wall extends between the lateral walls, which include the upright ribs, from the front wall to the back edges of the lateral walls, and wherein the retaining wall further comprises, in at least some of the courses, a batten extending through the lateral walls of a plural number of the concrete modules so that the batten if pulled backwardly can bear against the upright ribs of the lateral walls, through which the batten extends, of the plural number of the concrete modules.

4. The retaining wall of claim 3, wherein a geogrid is anchored to the retaining wall by the batten.

5. A retaining wall comprising stacked courses of concrete modules, wherein each concrete module has unitary walls including a front wall, two lateral walls, and a bottom wall, each lateral wall having a front edge adjoining the front wall, a back edge spaced from the front edge, and an upright rib extending inwardly from said lateral wall and an upright rib extending outwardly from said lateral wall, each said rib being spaced frontwardly from the back edge of said lateral wall and backwardly from the front edge of said lateral wall, each concrete module being open above the bottom wall, wherein the bottom wall extends between the lateral walls, which include the upright ribs, from the front wall to the back edges of the lateral walls, and wherein the retaining wall further comprises, in at least some of the courses, a batten extending through the lateral walls of a plural number of the concrete modules so that the batten if pulled backwardly can bear against the upright ribs of the lateral walls, through which the batten extends, of the plural number of the concrete modules.

6. The retaining wall of claim 5, wherein a geogrid is anchored to the retaining wall by the batten.

7. A retaining wall comprising stacked courses of concrete modules, wherein each concrete module has unitary walls including a front wall, two lateral walls, and a bottom wall, each lateral wall having a front edge adjoining the front wall, a back edge spaced from the front edge, and an upright rib extending inwardly from said lateral wall and upright ribs extending outwardly and inwardly from said lateral wall, each said rib being spaced frontwardly from the back edge of said lateral wall and backwardly from the front edge of said lateral wall, each concrete module being open above the bottom wall, wherein the bottom wall extends between the lateral walls, which include the upright ribs, from the front wall to the back edges of the lateral walls, and wherein the retaining wall further comprises, in at least some of the courses, a batten extending through the lateral walls of a plural number of the concrete modules so that the batten if pulled backwardly can bear against the upright ribs of the lateral walls, through which the batten extends, of the plural number of the concrete modules.

8. The retaining wall of claim 7, wherein a geogrid is anchored to the retaining wall by the batten.

9. The retaining wall of any one of claims 1 through 8, wherein batten extends through a recess opening upwardly in each lateral wall of the plural number of the concrete modules.

10. The retaining wall of any one of claims 1 through 8, wherein the batten extends through an opening, which has an uninterrupted margin, through each lateral wall of the plural number of the concrete modules.

* * * * *

UNITED STATES PATENT AND TRADEMARK OFFICE

CERTIFICATE OF CORRECTION

PATENT NO. : 6,761,509 B2
DATED : July 13, 2004
INVENTOR(S) : Jan Erik Jansson

It is certified that error appears in the above-identified patent and that said Letters Patent is hereby corrected as shown below:

Column 4,
Lines 13 and 14, the second occurrence of "and an upright rib extending inwardly from said lateral wall" should be deleted.

Signed and Sealed this

Thirtieth Day of November, 2004

JON W. DUDAS
*Director of the United States Patent and Trademark Office*